US009759490B2

(12) United States Patent
Calvi et al.

(10) Patent No.: US 9,759,490 B2
(45) Date of Patent: Sep. 12, 2017

(54) OXYGEN LANCE WITH AT LEAST ONE COIL

(71) Applicants: John Adrian Calvi, Bentleigh East (AU); Rodolfo Daniel Duran, Aspendale (AU)

(72) Inventors: John Adrian Calvi, Bentleigh East (AU); Rodolfo Daniel Duran, Aspendale (AU)

(73) Assignee: LEWIS AUSTRALIA PTY LTD (AU)

( * ) Notice: Subject to any disclaimer, the term of this patent is extended or adjusted under 35 U.S.C. 154(b) by 104 days.

(21) Appl. No.: 14/924,738

(22) Filed: Oct. 28, 2015

(65) Prior Publication Data

US 2016/0047601 A1 Feb. 18, 2016

Related U.S. Application Data

(63) Continuation-in-part of application No. 13/284,238, filed on Oct. 28, 2011, now abandoned.

(30) Foreign Application Priority Data

Oct. 29, 2010 (AU) ..... 2010904831

(51) Int. Cl.

| | |
|---|---|
| ***F27D 3/16*** | (2006.01) |
| ***F27D 3/15*** | (2006.01) |
| ***C21C 5/46*** | (2006.01) |
| ***C21C 7/00*** | (2006.01) |
| ***C21B 7/12*** | (2006.01) |

(52) U.S. Cl.

CPC ..... *F27D 3/16* (2013.01); *C21B 7/12* (2013.01); *C21C 5/462* (2013.01); *C21C 5/4653* (2013.01); *C21C 7/0056* (2013.01); *F27D 3/1518* (2013.01); *F27D 3/1527* (2013.01); *C21C 5/4606* (2013.01); *F27D 2003/168* (2013.01); *F27D 2003/169* (2013.01)

(58) Field of Classification Search

CPC ..... F27D 3/16; F27D 3/1518
USPC ..... 266/225
See application file for complete search history.

(56) References Cited

U.S. PATENT DOCUMENTS

| | | | | |
|---|---|---|---|---|
| 4,761,178 | A | 8/1988 | Griffing et al. | |
| 4,820,288 | A | 4/1989 | Isono | |
| 8,221,677 | B2 | 7/2012 | Colavito et al. | |
| 2012/0139171 | A1* | 6/2012 | Calvi | F27D 3/16 266/225 |
| 2016/0047601 | A1* | 2/2016 | Calvi | F27D 3/16 266/45 |

FOREIGN PATENT DOCUMENTS

| | | |
|---|---|---|
| JP | 62-156212 | 7/1987 |
| JP | 09-310981 | 12/1997 |

* cited by examiner

*Primary Examiner* — Scott Kastler
(74) *Attorney, Agent, or Firm* — Galbreath Law Offices, P.C.; John A. Galbreath

(57) ABSTRACT

An oxygen lance assembly that is at least capable of moving towards or away from the object to be lanced, said assembly including a supply of gaseous oxygen and metallic tubing wherein the oxygen supply is continuously feed through the said tubing when the lance is in use, and the said lance assembly includes a reel, and the said metallic tubing is coiled upon and carried by the said reel, and when in use, the metallic tubing is continuously uncoiled from the said reel as the said metallic tubing is consumed during use.

17 Claims, 11 Drawing Sheets

OXYGEN LANCE WITH AT LEAST ONE COIL

CROSS-REFERENCES TO RELATED APPLICATIONS

This is a continuation-in-part of parent application Ser. No. 13/284,238, which was filed on Oct. 28, 2011 and which was abandoned on Feb. 2, 2016. This application claims priority from, and relies on, the aforementioned parent application.

FIELD OF THE INVENTION

This invention relates to the field of oxygen lances, particularly to the type used to open tapping holes in furnaces.

BACKGROUND OF THE INVENTION

Oxygen lances are regularly used for a number of different purposes, from cutting metal objects such as beams and other structural members through to opening tapping holes in furnaces and crucibles.

The basic oxygen lance is a simple device that includes a metallic tube of around 4 m in length, and an oxygen supply. A supply of oxygen gas is continuously fed through the tube. Once the oxygen lance is ignited, the supply of oxygen sustains the continuous burning of the metal tubing. The result is a lance with an extremely high heat that is capable of melting and burning through a wide range of suitable objects. The metal tubing is consumed when the lance is in use, and therefore the lance needs to be fitted with fresh tubes at regular intervals to replenish the tubes as they are consumed by the use of the lance. A thermic lance operates in a similar way but includes wires (usually steel) inserted within the metallic tube to provide additional fuel for more heat generation.

One particular application of a lance is the use on furnaces to open tapping holes. Furnaces used in metallurgy run at very high temperatures. The refractory materials used to line the interior of these furnaces are capable of operating at these elevated temperatures, however specialized cooling panels are sometimes integrated into the furnace wall to extend the life of the refractory by conducting some heat away. Typically, a large furnace is fitted with a plurality of tapping holes that are used to tap molten metal contained in the furnace. When not in use, these tapping holes are blocked with a refractory mud or clay. This plug is inserted using a clay or mud gun or manually with a bot (clay plug wrapped in refractory fabric pushed in with a steel rod). The plug sets very hard and has a high resistance to heat. The combination of the plug of refractory clay and the cooling panels built into the furnace wall allow a plug of solidified metal to form adjacent to the refractory clay plug. This then remains in place until the next tapping operation falls due, upon which both the refractory mud plug and plug of solidified metal then needs to be removed.

One common way of removing the plugs is by burning through them using an oxygen lance. The tip of the lance burns at around 4,000° C., and is capable of burning through the refractory clay or mud plug material and the solidified metal in the tap hole. Another common way is to first break away the solidified refractory mud plug, thereby exposing the plug of solidifies metal that then needs to be re-melted in order to open the tapping hole.

It is common for a lance to need to be fitted with 10 to 20 fresh tubes in order to open just one tapping hole. This means that the operation needs to be halted 10 to 20 times while the lance is withdrawn from the hole and a fresh tube attached. Each time the lancing operation is halted, the tap hole re-cools to some degree. The environment where this operation needs to take place is inherently dangerous given the extreme heat of the furnace being operated on, the extreme heat of the oxygen lance itself, and the presence of oxygen around molten metals. The need to regularly stop the operation, withdraw the lance, fit it with a fresh tube and then re-insert the lance into the tapping hole adds considerable time to the tapping operation, as well as increases the exposure of the lance operators to risk.

It is an object of the present invention to overcome, or at least ameliorate, the aforementioned problems.

DISCLOSURE OF THE INVENTION

The present invention is an oxygen lance assembly that is at least capable of moving towards or away from the object to be lanced. The assembly includes a supply of gaseous oxygen and metallic tubing wherein the oxygen supply is continuously feed through the tubing when the lance is in use. The lance assembly includes a reel, and the metallic tubing is coiled upon and carried by the reel. When in use, the metallic tubing is continuously uncoiled from the reel as the metallic tubing is consumed during use of the lance.

Preferably the lance has a series of rollers that the metallic tubing passes through after it is uncoiled from the reel in order to straighten and guide the tubing.

Preferably at least one of the rollers in the series of rollers has adjustable means to adjust the straightening of the tubing.

Preferably the lance has a set of pinch rollers, and these rollers are capable of pulling on the tubing, and it is at least this pulling action that causes the metallic tubing to uncoil from the reel during use.

Preferably the rotation of the reel to uncoil the metallic tubing is powered by a motor, and the tubing is thereby forced through the series of straightening rollers by the powered uncoiling of the reel.

Preferably the tail end of the metallic tubing in one reel is connectable to the leading end of the metallic tubing in a subsequent reel so as to allow substantially continuous operation of the said lance as each reel of metallic tubing is consumed during use.

Preferably the tail end of the metallic tubing has a region of reduced diameter wherein the outer diameter of the said region is capable of being inserted into the inner diameter of the leading end of a new coil of metallic tubing such that when a reel of metallic tubing is consumed, the leading end of new reel of metallic tubing is slid over the region of reduced diameter so as to connect the ends of the metallic tubing together.

Preferably the reel is capable of accommodating a coil of metallic tubing that is at least 50 or 100 meters or more in linear uncoiled length, however in consideration of weight and handling requirements, the coils are typically in the range of 18 to 30 meters in linear uncoiled length.

Optionally the metallic tubing used in the lance includes additional fuel wires incorporated into the tube.

Preferably the lance is carried on a body that is suspended from a ceiling, and the body is movable in three dimensions.

Preferably the body contains strain gauges or similar features to provide feedback to the lance operators of the forward acting force being applied to the lance during operation.

Preferably the oxygen lance includes a shield to minimise the splash back of sparks and/or molten material erupting from the tap hole as it is being lanced. The shield is comprised of a planar sheet of suitable heat resistant material. The planar sheet includes a suitable notch or orifice that allows the metallic tubing of the lance to pass through the planar sheet.

Preferably the oxygen lance assembly includes a tap hole plugging tool. The tap hole plugging tool comprises of a shaft member that is removably fastenable to the oxygen lance assembly at one end, and the shaft extends in the direction of the metal tubing of the lance and has a plunger permanently attached at the opposite end of the shaft. The plunger being capable of holding a plug of suitable material for the tap hole, and the oxygen lance assembly with the plugging tool attached is then used to position and force the plug into position relative to the tap hole. In this arrangement the oxygen lance assembly is reconfigured to allow it to close a furnace tap hole.

In another aspect, the present invention is a lance assembly for lancing any one of a plurality of spaced apart tapping holes in a furnace side wall. The lance assembly is supported on a movable frame, and the frame is adapted to enable the lancing assembly to move in three dimensions so that the lance assembly is able to be aligned with specific tapping hole to be lanced, and lances the tapping hole from the exterior face of the side wall. The lance assembly has at least one coil of metallic tubing that defines a first coil bank that is supported on a first reel, and a supply of gaseous oxygen that is adapted to be releasably connected to the trailing end of the first coil bank. The lance assembly has first unwinding means that are adapted to draw the tubing off the first reel and forcing it through first straightening means so that the tube is thereby straightened, defining a first lance. During operation of the lance assembly, when the first lance is in use, oxygen flows through the first coil bank and the first lance, and the first unwinding means are adapted to draw the tubing off the first reel at the same rate that the tube is being consumed by the lancing operation.

In another preferred aspect of the invention, the lance assembly has a second reel that is adapted to support at least one coil of metallic tubing that defines a second coil bank, independent of the first coil bank. A supply of gaseous oxygen is adapted to be releasably connected to the trailing end of the second coil bank. The lance assembly has second unwinding means that are adapted to draw the tubing off the second reel and forcing it through second straightening means so that the tube is thereby straightened, defining a second lance. During operation of the lance assembly, when the second lance is in use, oxygen flows through the second coil bank and second lance, the second unwinding means are adapted to draw the tubing off the second reel at the same rate that the tube is being consumed during the lancing operation.

Preferably when either the first or second reels support more than one metallic coil simultaneously in its respective coil bank, the trailing end of the preceding coil is connected to the leading end of the trailing coil in the respective coil bank. The connection between adjacent coils in either coil bank is both gas tight, to prevent the escape of gaseous oxygen flowing through the coil bank, and is also adapted to withstand the drawing force of the respective unwinding means without breaking the connection.

Preferably the first and second unwinding means is a set of first and second pinch rollers respectively, and each set are adapted to grab the metallic tubing that is fed to it from its associated coil bank.

Preferably the assembly has logic control means that receives signals from a plurality of sensors on the assembly, and command and control signals from an operator. The logic control means are capable of controlling a plurality of servo motors that are used to position the lance assembly in three dimensions, and also control the first and second pinch rollers, and activate and deactivate the supply of oxygen to each respective coil bank, and associated lance, depending on which lance is in operation at any one time. The logic control means are capable of retracting the unused lance a sufficient distance, independently of the lance that is in operation, so that the unused lance is kept away from the vicinity of the area being operated upon by the lance that is in operation.

Preferably the assembly includes a sensor that is capable of determining that the tip of the lance that is in operation is in very close proximity to, or is in fact touching the plug in the tapping hole being lanced. When the position of the lance tip is advanced towards the plug in the tapping hole being lanced, and when the sensor is tripped, it sends a signal back to the logic control means which then causes the logic control means to rapidly retract the lance a short distance that corresponds to the optimal operational gap between the tip of the lance and the plug in the tapping hole that is being lanced, and this advancement and retraction of the lance is repeated with sufficient frequency so that a mean optimal gap is maintained between the tip of the operating lance and the plug as the lance is consumed, and the face of the plug being lanced melts away, during the lancing operation.

Preferably the assembly includes a sensor that is able to determine if the joint between adjacent coils in a particular coil bank has failed as the coil is drawn off the reel, and when tripped, the sensor rapidly send a signal to the logic control means that immediately shuts off the supply of oxygen to that coil bank, and rapidly retracts the lance from the tapping hole.

In one preferred aspect of the invention, the first and second coil banks are comprised of a coil or coils of the same type so that during operation, the operator can operate the lance assembly using one coil bank until it reaches depletion, then rapidly reconfigure the assembly to continue with the lancing operation using the other coil bank. Then once both the first and second coil banks are depleted, the assembly can be taken offline so that the first and second reels on the assembly can be supplied with fresh coils that are then interconnected to therefore replenish the respective coil banks, ready for the next lancing operation.

In another preferred aspect of the invention, the first and second coil banks are comprised of a coil or coils different types so that one coil bank produces a lance that has different lancing properties to the lance produced by the other coil bank, and the operator can rapidly reconfigure the lance assembly to swap between the two types of lance.

Preferably one coil bank is comprised of hollow metal tubing, and the other coil bank is comprised of rod filled tubing, also known as thermic tube.

In another preferred aspect of the invention, when a plurality of coils are used in a coil bank, the leading end of a particular coil has a region that is narrowed so that narrow region is insertable into the interior diameter of the trailing end of the preceding coil. The resulting connection has a curved profile that matches the curvature of the coil bank, and is gas tight and has sufficient strength that is capable of resisting the tensile force applied to it as it is drawn off its respective reel by its respective pinch roller.

Preferably a tool is used that is adapted to force the ends together with sufficient force to force the connection.

Preferably the connection is subsequently crimped to give the connection greater tensile force resistance from the respective coil bank's pinch roller.

In another aspect of the invention, an insert is used to connect the respective leading and trailing end of adjacent coils in a respective coil bank, and the insert has a similar curved profile to that of the coil bank, and the when each respective end of the adjacent coils are connected to the insert, the resulting join is both gas tight and capable of resisting the tensile force applied to it when it is drawn off its respective reel by the operation of the respective pinch roller.

Preferably the insert includes at least one O ring for each respective end of the adjacent coils, and the O ring aids in establishing and maintaining a gas tight seal during the unwinding action from its respective coil bank, and subsequent straightening operation.

In another aspect of the invention, the logic control means are adapted to receive command and control signals remotely from an operator in a separate control room to the furnace, and a combination of sensors and cameras, as well as the preconfigured mapping of the location of each tapping hole in the furnace side wall, combine to enable the lancing assembly to function substantially autonomously.

In another aspect of the invention, a refractory mud applicator is included in the assembly, and the logic control means is adapted to rapidly reconfigure the assembly so that the mud applicator is used to re-plug the tapping hole when the tapping hole is ready to be re-plugged.

In another aspect, the present invention is a method of tapping any one of a plurality of tapping holes in the side wall of a furnace using a lance assembly including the steps of:

a) locating the current position of the lancing assembly in respect of a set of reference X, Y and Z co-ordinates,
b) using a pre-programmed map in logic control means to control the position of the lance assembly via a plurality of servo motors and aligning the assembly with the particular tapping hole in the plurality of tapping holes to be lanced,
c) switching on a flow of gaseous oxygen via the logic control means so that the oxygen flows through a coil bank of metallic coil carried upon a reel carried on the assembly,
d) using logic control means to operate a set of pinch rollers that are carried on the assembly so that metallic coil is drawn off the reel and forced through a set of straightening rollers that straighten the drawn coil length and thereby define a lance,
e) igniting the lance,
f) using the logic control means to control both the servo motors and the pinch rollers to advance the tip of the lance towards the plug in the tap hole to be lanced so that when it is very near to, or actually makes contact with, the plug, the logic control means retracts the lance a short distance that matches the optimal gap distance between the tip of the lance and the plug to be lanced,
g) repeating step f. with sufficient frequency so that a mean optimal gap between the lance head and the plug is maintained as the lance is consumed and the face of the plug melts until the plug has been fully lanced, thereby opening the particular furnace tap hole.
h) using the logic control means to rapidly withdraw the lance from the vicinity of the opened tap hole.
i) using the logic control means to shut off the supply of oxygen to the lance, thereby extinguishing it.

DETAILED DESCRIPTION OF THE PREFERRED EMBODIMENTS

Figure 1:
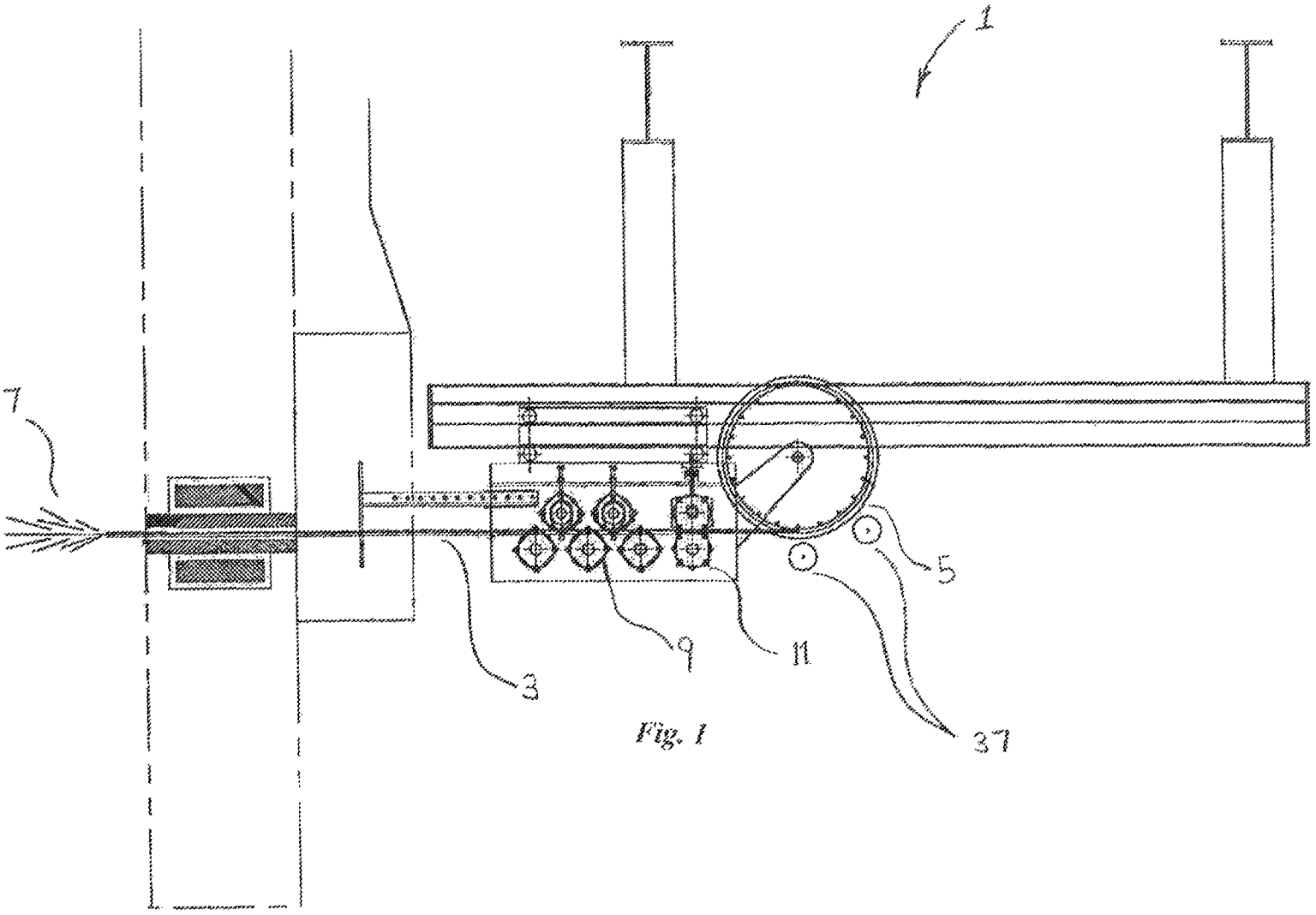
FIG. 1 shows a side view of the oxygen lance in accordance with the present invention shown in the configuration where it is suspended from a ceiling.

Turning firstly to FIG. 1, we see an oxygen lance 1 having a gaseous oxygen supply (not shown) and metallic tubing 3 that is carried on the lance in the form of a coil which is carried upon reel 5. When the lance is in use, the metallic tubing 3 is consumed by the flame 7, and new tubing is continuously fed from the coil. As the metallic tubing 3 is unwound from the coil it passes through a series of adjustable straightening and guide rollers 9. The coils of tubing are supplied in the form of a cartridge that can be very quickly placed onto the reel 5 when necessary, and have the oxygen supply re-attached.

The coil is either pulled from the coil using a pair of pinch rollers 11, or alternatively, the reel is coupled to an electric pneumatic or hydraulic motor which provides the torque required to turn the reel, or a combination of both the push of the motor and the pull of the pinch rollers 11 may be used in conjunction with one another. Optionally a set of guide rollers 37, or a guide rail (not shown) is attached to the reel to ensure that as the reel is turned by the electric motor, the metallic tubing is unable to simply unwind off the reel and not travel through the straightening rollers.

Figure 2:
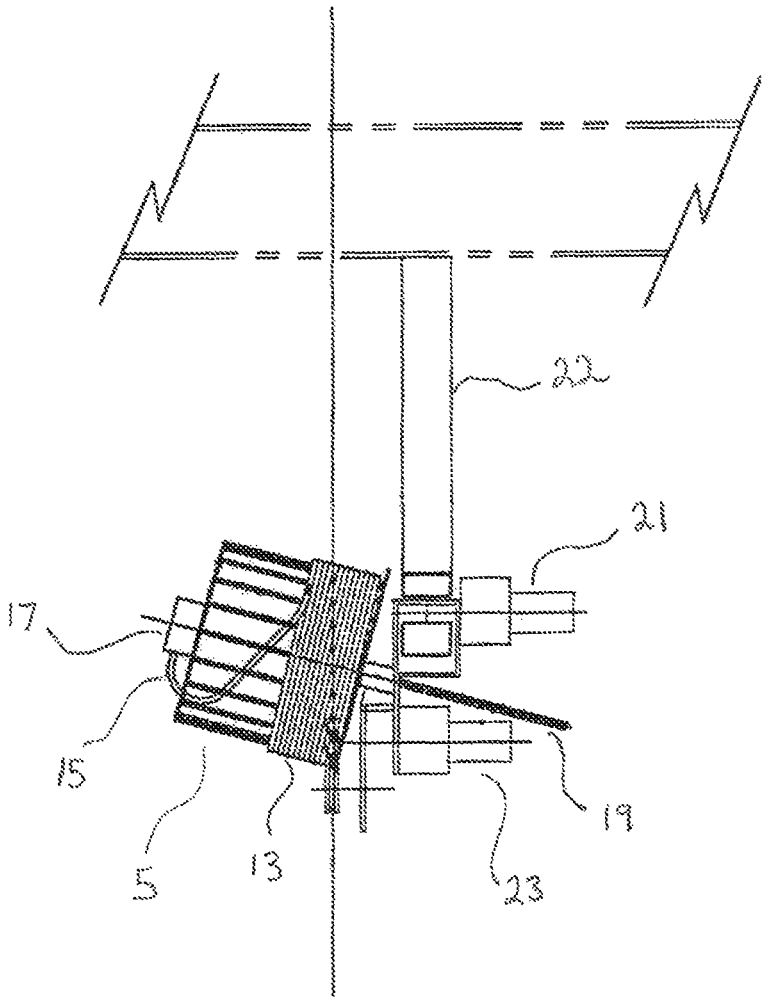
FIG. 2 shows a rear end view of the lance.

Turning to FIG. 2 we see a rear end view of the lance showing the coil of metallic tubing 13 coiled around the reel 5. An oxygen supply line 15 is attached to the trailing edge of the metallic coil. The opposite end of the oxygen supply line 15 is attached to a valve with a rotary joint 17. The oxygen is fed to the valve 17 via supply hose 19 which is attached to the oxygen supply remote from the lance assembly. In this embodiment, the lance assembly is wholly suspended from the ceiling via a support member 22. This is preferable due to the fact that the tapping floor of a furnace is typically a very busy area with sub-floor launders or above floor launders in place to channel the flow of molten metal from the furnace. In other environments, it is conceivable for the lance to be wholly supported by the floor and run on rails or the like to allow for the lance to be moved towards or away from the job to be worked on by the lance.

An index motor 21 may be provided to move the lance assembly closer to, or away from the job to be worked on. Another motor 23 may be included to feed the tube off the reel during the use of the lance. This motor may be used in conjunction with a set of pinch rollers 11.

Figure 3:
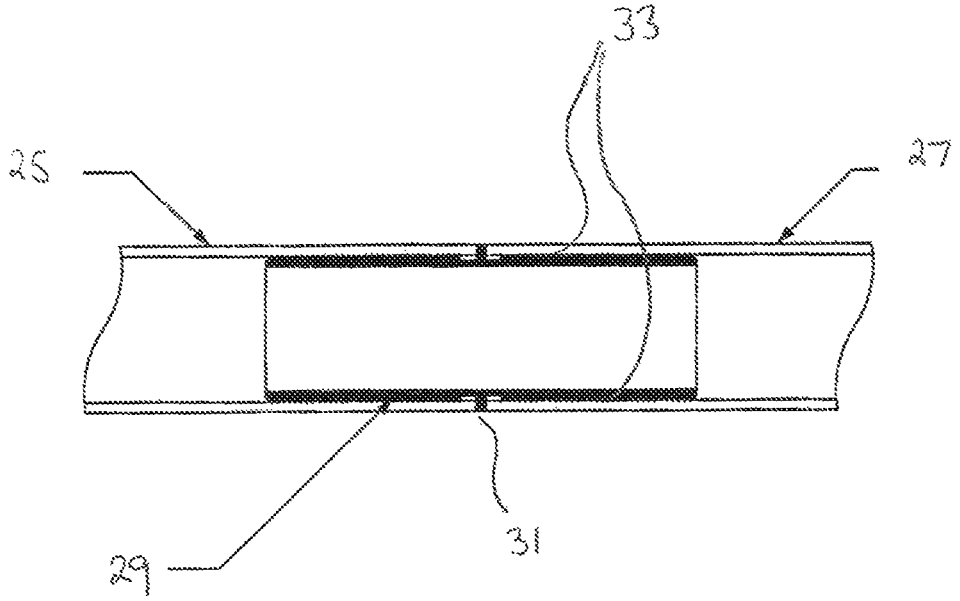
FIG. 3 shows one form of connector that can be used to connect the tail end of one coil of metallic tubing the leading end of a subsequent coil of metallic tubing. This connector has barb rings or serrations that ensure that once the connection is pushed together, it cannot be pulled apart.

Before a cartridge of metallic tubing has been consumed, a new cartridge is placed upon the reel 5, and the trailing end of the preceding metallic tube is connected to the leading edge of the new cartridge of metallic tubing. FIG. 3 shows one preferred way in which the two ends are joined. The trailing end 25 of the metallic tubing from the preceding cartridge is butted against the leading end 27 of the metallic tubing in the new cartridge. The two ends meet at the join 31 and a connector member 29 is inserted into each end and makes an interference fit to hold the ends together. It is preferable that the connector 29 includes a set of serrations 33 to make the connector 29 easier to insert into the ends, and to improve the oxygen seal.

Figure 4:
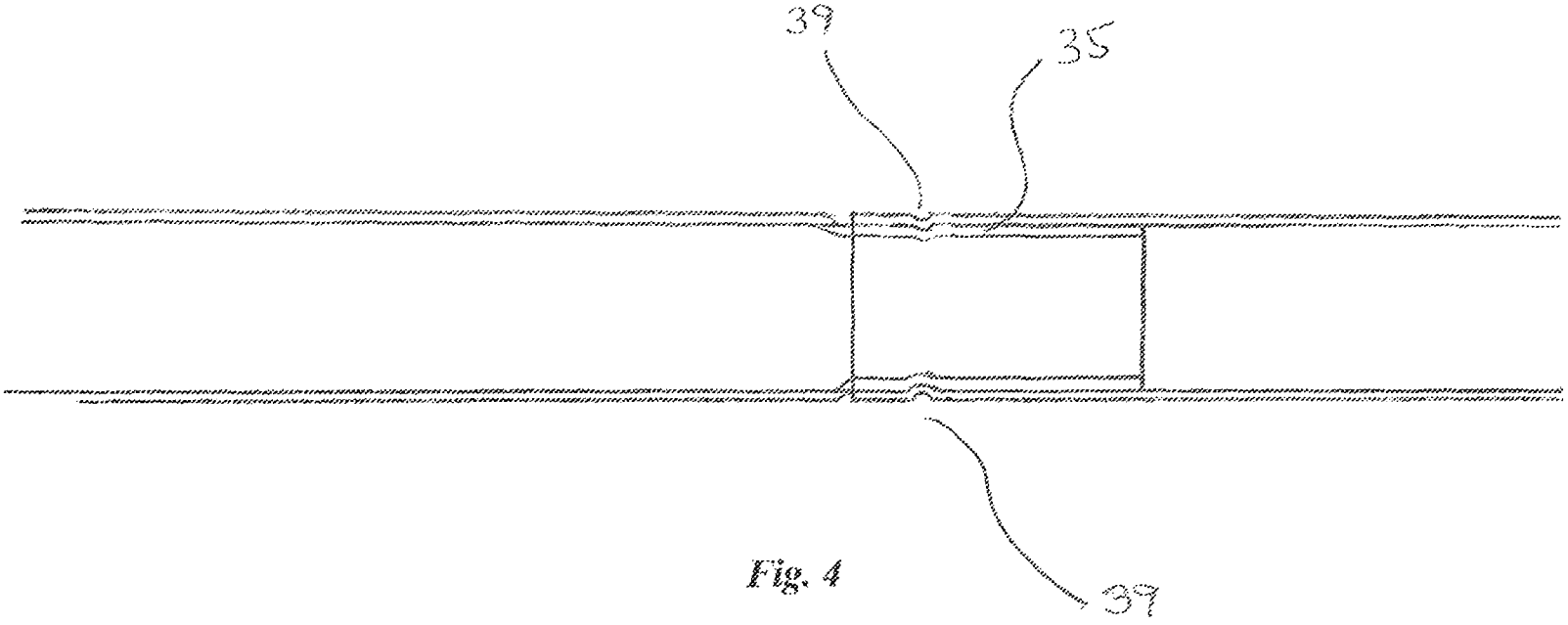
FIG. 4 shows an alternative connection using one swaged end inserted into the end of the previous coil and then crimped together as shown with a special hand tool to prevent separation and create effective gas sealing. Alternatively the joint can be glued together.

There is also an alternative method of joining the ends together. Instead of using a connector, either the lead end 27 of the metallic tubing from the new cartridge, or the trailing end 25 of the preceding metallic tubing may have a region that is of reduced diameter 35, as shown in FIG. 4. The outside diameter of 35 is sized so that it is insertable into an end of the metallic tubing. If the trailing end 25 of the preceding metallic tubing has the region 35, then it is insertable into the leading end 27. Conversely, if the leading end 27 has the region of reduced diameter 35, then it is insertable into the trailing end 25 of the preceding metallic tubing. Optionally the joined ends may be crimped as shown at 39 to increase the strength of the join.

Figure 5:
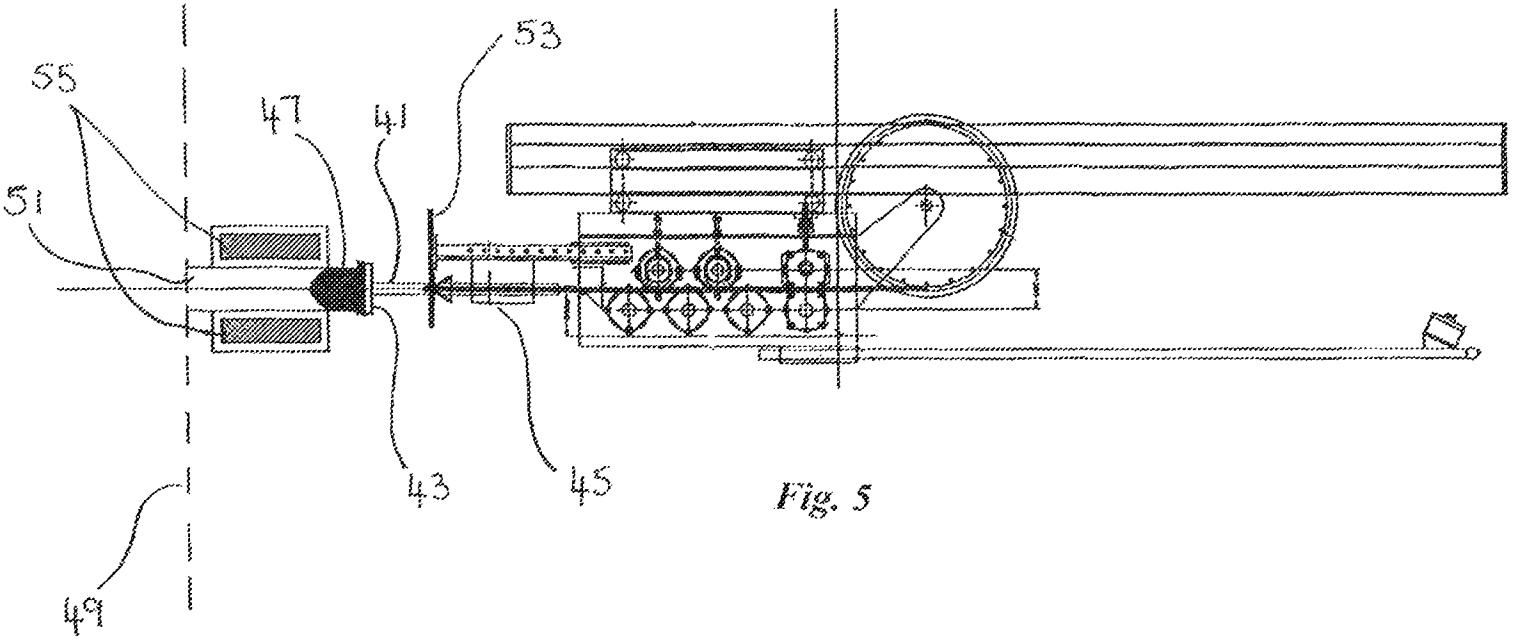
FIG. 5 shows a side view of the present invention with a tap hole plug plunger temporarily attached.

Turning to FIG. 5, we see that the present invention can be reconfigured to provide the means for plugging a tap hole that has been lanced open. A tap hole plug plunger comprising a shaft 41 and a plunger at its remote end 47 is removably fastenable to the body of the oxygen lance assembly via attachment means 45. In its simplest form, the fastening means is a clamp. The plunger 43 is capable of holding a plug of suitable refractory material(s), and the body of the oxygen lance assembly, can then be manipulated in three dimensions to enable the plug to be positioned and forced into the tap hole 51. When the operator(s) wishes to reconfigure the assembly from a lance to a tap hole plunger, they can simply trim any excess metal tubing that may be extending from the lance, and simply attach the tap hole plug plunger with a pre-prepared plug attached.

Figure 6:
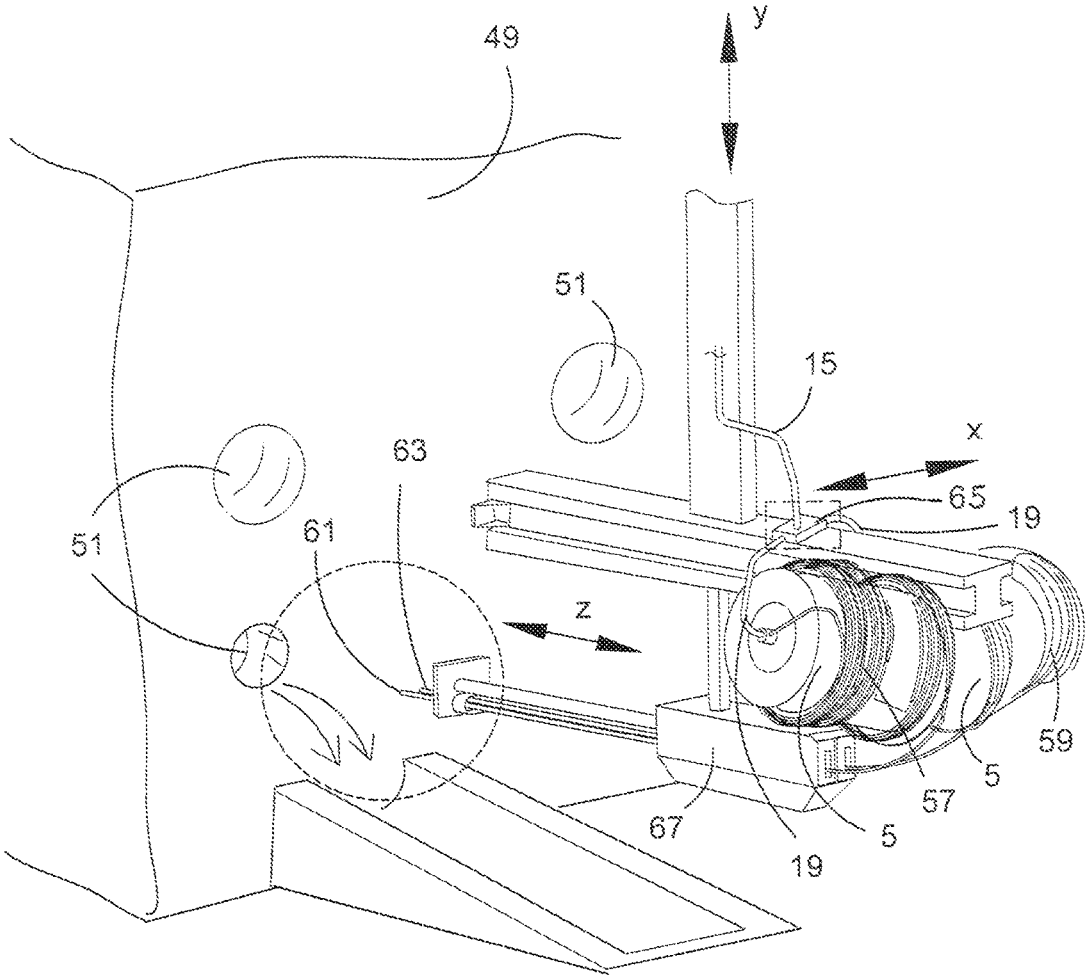
FIG. 6 is a isometric view of one preferred form of the present invention that has two separate coil banks that are each capable of producing a lance.

Turning to FIG. 6, we are shown another preferred embodiment of the invention in which the lance assembly is carried on a frame that is configured to move in three dimensions as shown by the three double ended arrows labelled X, Y and Z, and this enables an operator to move the lance to any one of a plurality of tapping holes 51 that are incorporated into a side wall 49 of the furnace. In this embodiment, the lance assembly includes a first coil bank 57 supported on a reel 5, and a second coil bank 59 on a separate reel 5. Each coil bank is made up of at least one coil of metallic tubing. Typically, up to four coils of metallic tubing of a similar type are supported by the reel 5. The trailing end of the preceding coil is connectable to the leading end of the adjacent coil. When all the coils carried upon the reel are properly interconnected, then they combine to form the respective coil bank. The leading end of each coil bank is fed through a respective port on the pinch roll and straightening roll housing 67, and the pinch roller is then capable of gripping the metallic tube and drawing it off is respective reel 5. Straight tube emerges from the housing 67 to form a first and second lance 61 and 63. In this embodiment they are shown side by side, however other arrangements would fall within the scope of this invention.

In one form of the invention, both the first and second coil banks 57 and 59 respectively, a comprised of at least one metallic coil of the same type. This produces two separate lances that have the same lancing properties. In this arrangement, and operator can operate the lance using just one coil bank until it has been depleted, then quickly reconfigure the lance to use the other coil bank. This enables the lancing operation to run for longer before the lance needs to be taken offline in order to replenish each coil bank.

In another form of the invention, the first coil bank 57 is comprised of at least one coil of metallic tubing having one set of lancing properties, while the other coil bank 59 is comprised of at least one coil of metallic tubing that has different lancing properties. For example, the first coil bank 57 could be comprised of at least one coil that is hollow, while the second coil bank 59 is comprised of at least one coil of metallic tubing that contains a plurality of metallic rods within the tubing's interior. This type of tubing is known as thermic tubing, and typically burns at a higher temperature than hollow tubing. When the lancing assembly is configured in this arrangement, the operator can quickly reconfigure the assembly to produce a lance that has the appropriate lancing properties for the particular task at hand.

A supply of gaseous oxygen is fed via oxygen supply line 15 to an oxygen supply selector valve 65. This selector valve enables an operator to control which coil bank and lance is supplied with a flow of oxygen. The oxygen is connected via oxygen hoses 19 to the end of each coil bank.

The lance assembly is capable of advancing the lance that is in use, and retracting the lance that is not, so that the inoperative lance is kept back out of the way.

Figure 7:
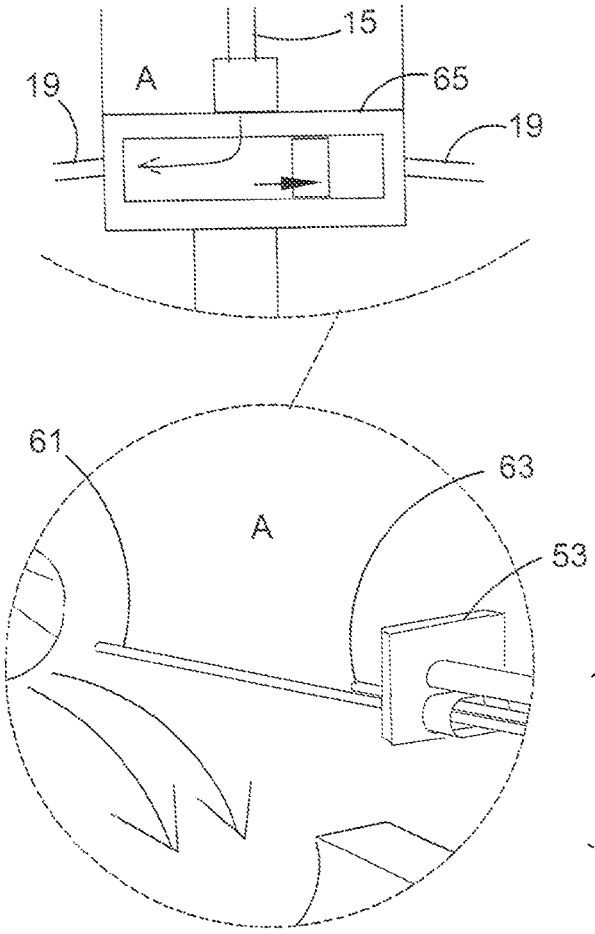
FIGS. 7 & 8 are close up views of the switchable oxygen gas supply to selectively control oxygen flow to each lance in the assembly.

Turning to FIG. 7 we are shown further detail of the oxygen supply selector valve 65 and how it can be operated to supply oxygen as shown in this example to the first coil bank only and blocking supply to the second coil bank, resulting in the first lance 61 being in operation while the inoperative lance 63 is retracted as shown.

Figure 8:
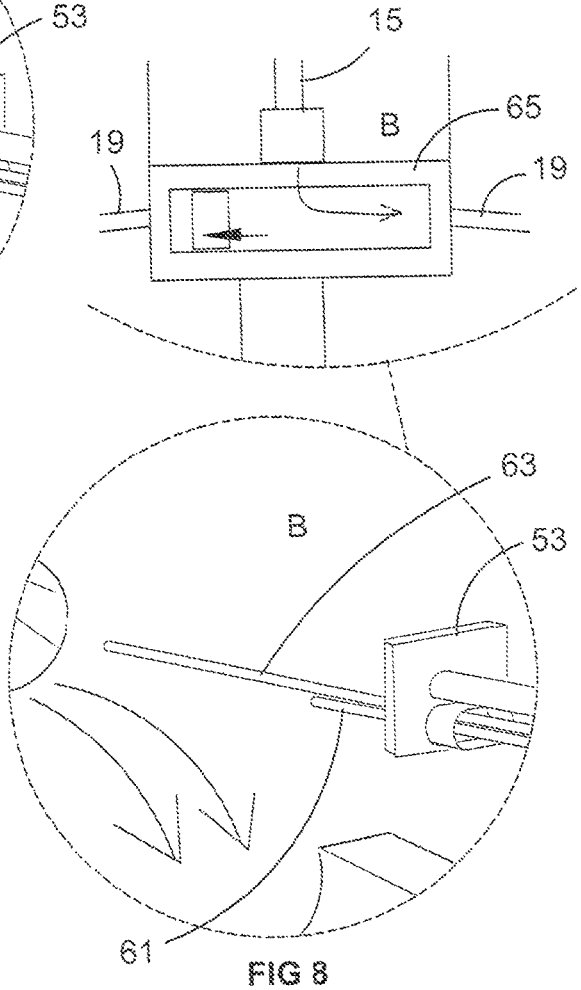

In FIG. 8 we are shown the opposite arrangement to FIG. 7

Figure 9:
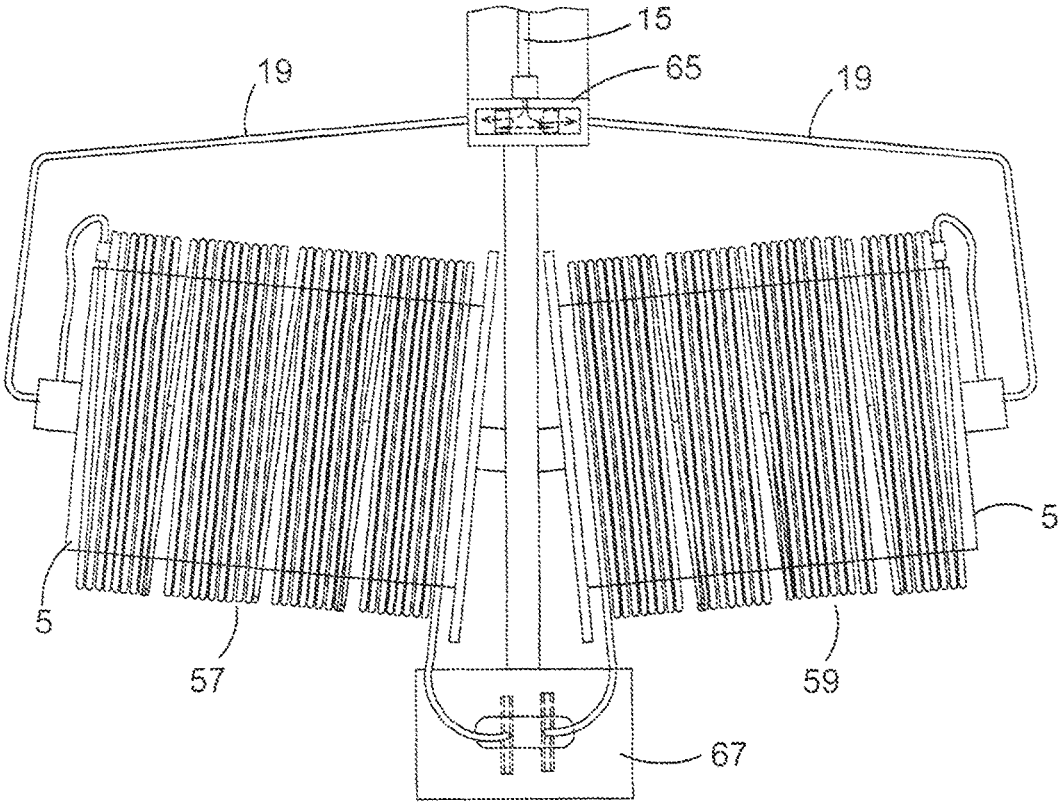
FIG. 9 is a rear view of one preferred form of the present invention.

Turning to FIG. 9 we are shown a rear view showing how the first coil bank 57 is carried upon its respective reel 5, and the second coil bank 59 is carried upon its respective reel 5. As shown, both the first and second coil banks in this example respectively comprise four separate coils of metallic tubing, and pair of adjacent coils in each coil bank are interconnected to provide a path that the gaseous oxygen can flow through and ultimately out through the corresponding lance.

Figure 10:
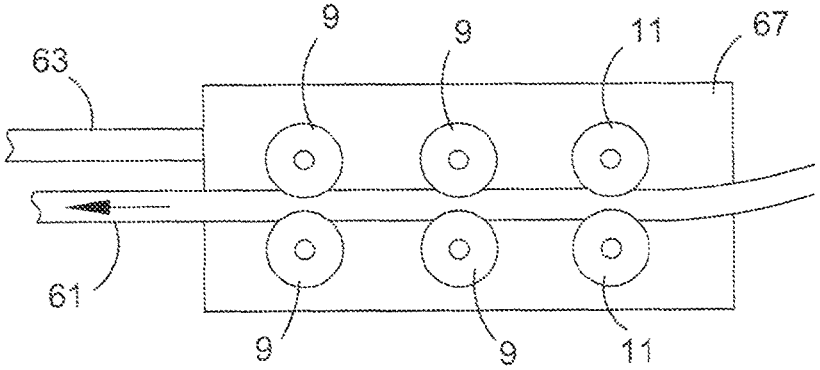
FIG. 10 shows a cut away side view of the pinch roller and straightening roller housing exposing both the pinch roller and the straightening rollers.

Turning to FIG. 10 we are shown a side view of the pinch roller and straightening roller housing 67 revealing the preferred arrangement of pinch rollers 11 and straightening rollers 9.

Figure 11:
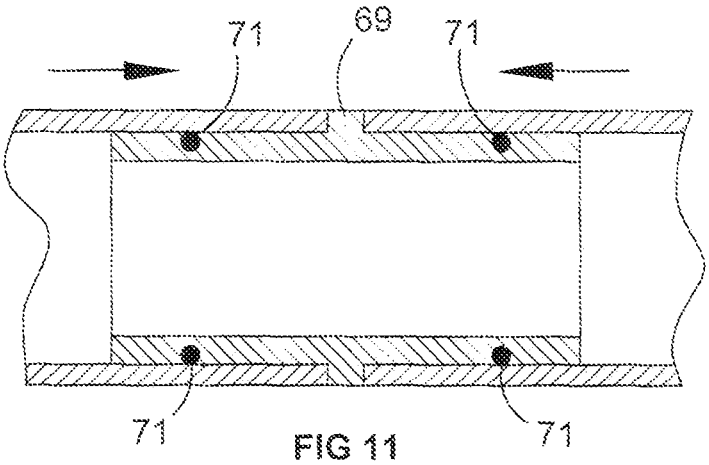
FIGS. 11 to 13 show alternative preferred embodiments of the joining method and apparatus between the corresponding ends of adjacent coils in a particular coil bank.
Figure 12:
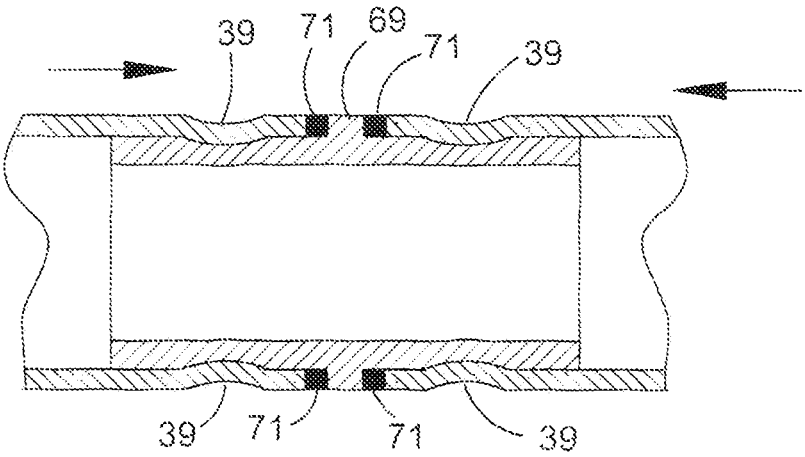
Figure 13:
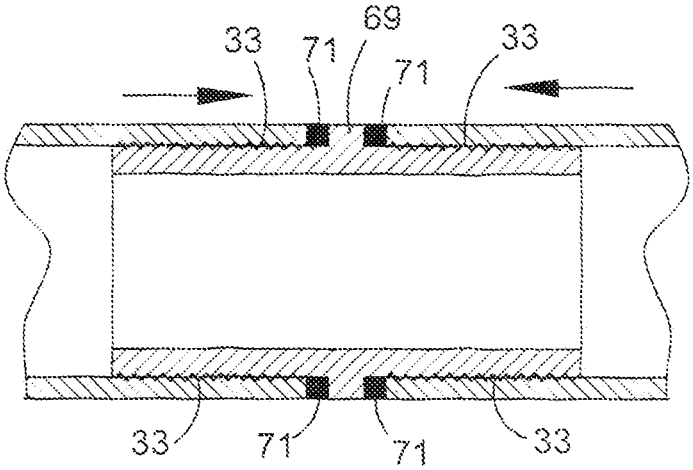

FIGS. 11 through 13 show various preferred embodiments for the joining of adjacent coils of metallic tubing in each respective coil bank. It is very important that the connection between the respective ends of adjacent coils in a particular coil bank is gas tight throughout the entire operation of the lance assembly. It is not shown in these views, however because the coil has a curved profile on its respective reel, the join also has a curved profile that closely matches the curvature in the coil. It is also very important that the integrity of the join is not compromised when the join is eventually subject to the direct tensile load of the pinch rollers when the length of coil containing the join is pulled from the coil bank. In FIG. 11 we see an insert 69 is used, and each respective end of the adjacent metallic coils are forced onto a respective end of the insert. The insert also includes an O ring 71 at each end that assist in keeping the joint gas tight. The interference fit is sufficient to withstand the tensile load of the action of the pinch rollers. FIG. 12 includes the extra step of a crimp 39 to enhance the joints resistance to the tensile force applied by the pinch rollers. In FIG. 13 serrations 33 are included to further enhance the tensile load resistance of the joint. In each case a separate hand held joining tool may be used to force the ends together onto the insert to ensure a proper connection.

Figure 14:
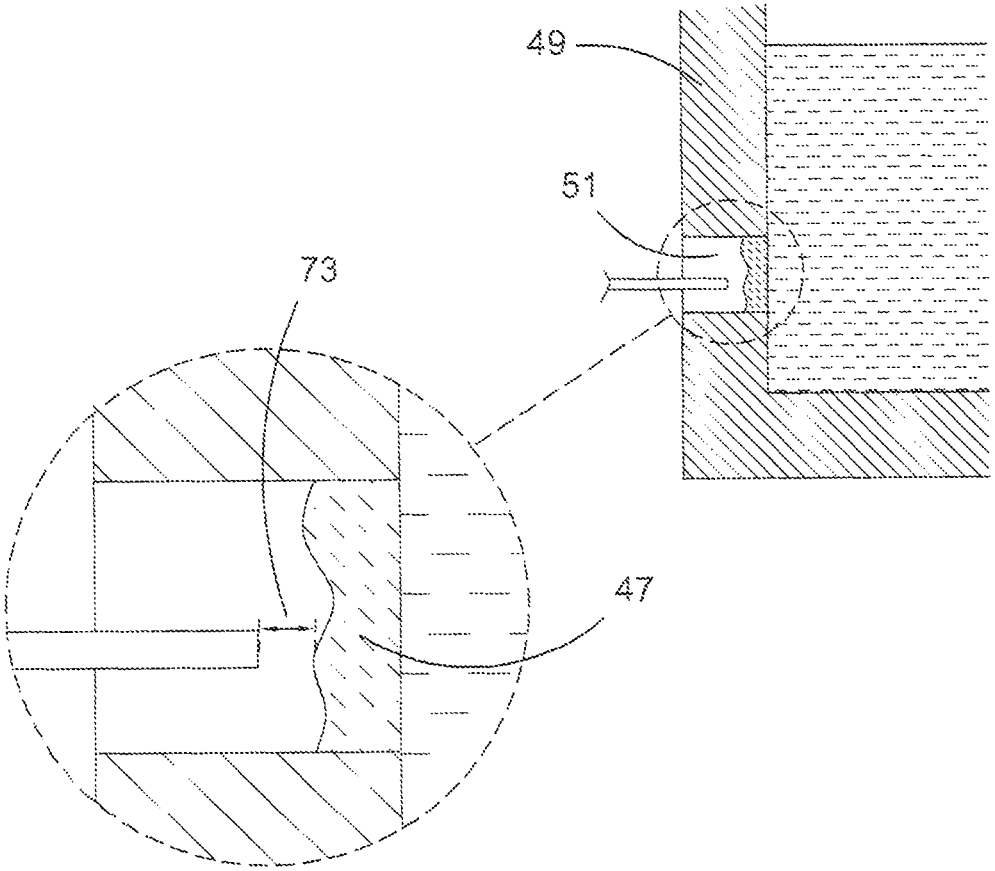
FIG. 14 is a close up view of the tip of the lance in the tapping hole and shows the optimal gap between the lance head and the object being lanced, in this case, the tap hole plug.

FIG. 14 shows a close up view of the tip of a lance in operation inside a tapping hole 51 that is built into the side wall 49 of a furnace. The plug inside a tapping hole typically comprises of solidified metal and refractory mud. In this example, a plug of solidified metal 47 is being lanced. There is an optimal gap between the tip of the lance, and the object being lanced. The difficulty with an automated system is determining where the tip of the lance is at any given time because during operation of the lance, end of the lance burns away, thereby continuously shortening the lance, and at the same time, the leading face of the object being lanced may melt or burn away. So maintaining the optimal gap distance between the lance and the object being lanced is a difficult task because of there is typically a lot of smoke in the vicinity created by the lancing operation. In a traditional manual operation of a lance, the person holding the lance in their hands is able to feel the size of the gap between the tip of the lance and the object being lanced by carefully advancing the lance towards the object being lanced. With experience, he or she is able to maintain an optimal gap distance.

A similar process is employed in the present invention. The lance assembly includes logic control means that controls a plurality of servo motors that are capable of moving the lance in the three axes of movement and also controlling the pinch rollers to extend or retract the lance. This combination of movements is deployed by the logic control means to extend the lance towards the object to be lanced. At least one sensor is deployed that is capable is sensing the close proximity, or physical touching, of the lance tip in relation to the object to be lanced. Once this close proximity is sensed, the logic control means then quickly retracts the lance tip a pre-defined distance that corresponds to the optimal gap distance as shown by the double ended arrow in FIG. 14. This is then repeated as rapidly and as frequently as required to maintain an average optimal gap distance during the entire lancing operation.

Figure 15:
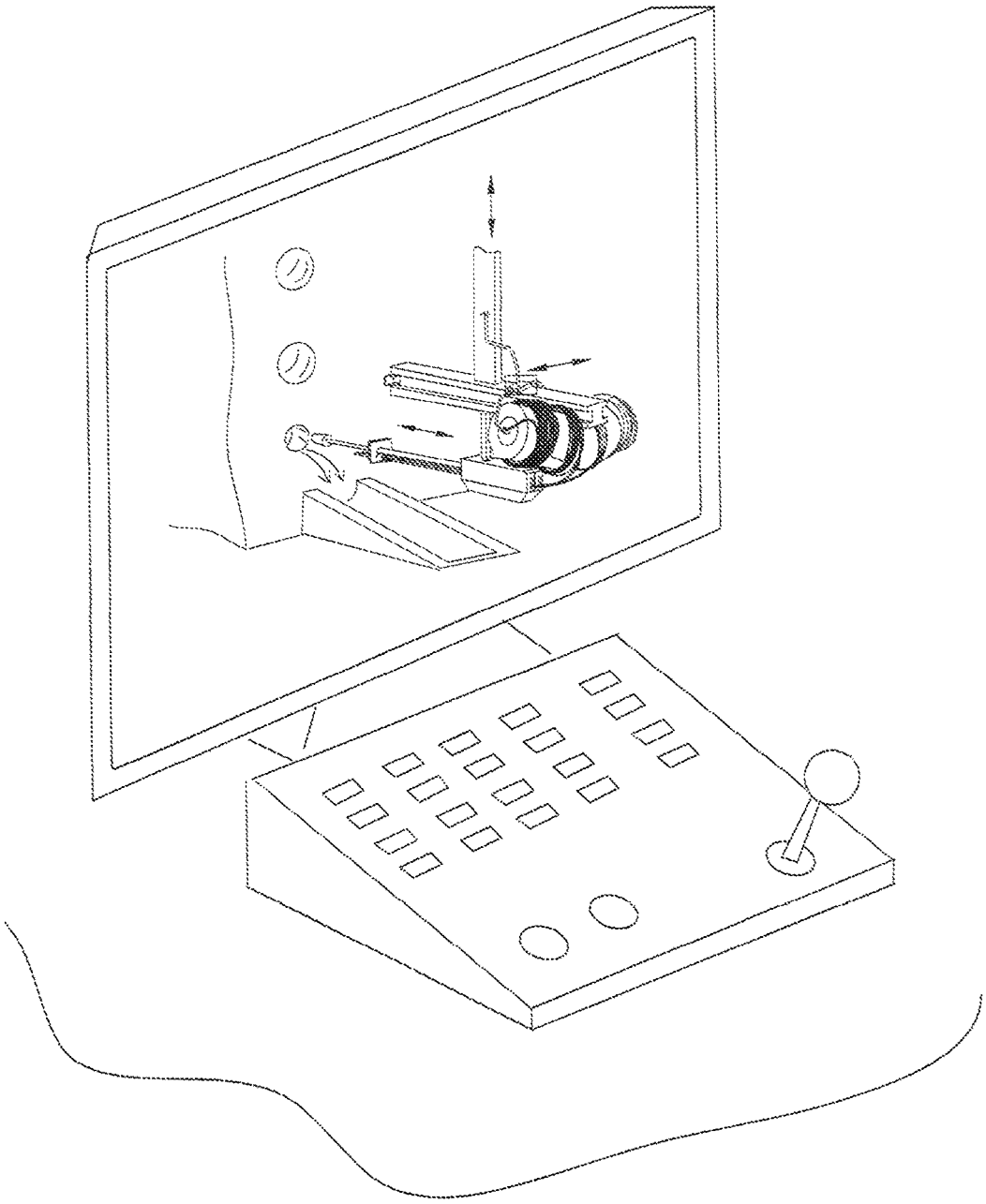
FIG. 15 shows the lance assembly of the present invention being remotely monitored and controlled remotely by an operator.

Finally in FIG. 15, we are shown an illustration of the lancing assembly be controlled remotely by an operator from the relative safety of a separate control room to the furnace room.

While the above description includes the preferred embodiments of the invention, it is to be understood that many variations, alterations, modifications and/or additions may be introduced into the constructions and arrangements of parts previously described without departing from the essential features or the spirit or ambit of the invention.

It will be also understood that where the word "comprise", and variations such as "comprises" and "comprising", are used in this specification, unless the context requires otherwise such use is intended to imply the inclusion of a stated feature or features but is not to be taken as excluding the presence of other feature or features.

The reference to any prior art in this specification is not, and should not be taken as, an acknowledgment or any form of suggestion that such prior art forms part of the common general knowledge.

The claims defining the invention are as follows:

1. A lance assembly for lancing any one of a plurality of spaced apart tapping holes in a furnace side wall, wherein the lance assembly is supported on a movable frame, and the frame is adapted to enable the lancing assembly to move in three dimensions so that the lance assembly is able to be aligned with specific tapping hole to be lanced, and lances the tapping hole from the exterior face of the side wall, and wherein said lance assembly has at least one coil of metallic tubing that defines a first coil bank that is supported on a first reel, and a supply of gaseous oxygen that is adapted to be releasably connected to the trailing end of the first coil bank, and said lance assembly has first unwinding means that are adapted to draw the tubing off the first reel and forcing it through first straightening means so that the tube is thereby straightened, defining a first lance, so that during operation of the lance assembly, when the first lance is in use, oxygen flows through the first coil bank and the first lance, and the first unwinding means are adapted to draw the tubing off the first reel at the same rate that the tube is consumed during the lancing operation.

2. A lance assembly as defined in claim 1 wherein the assembly has a second reel that is adapted to support at least one coil of metallic tubing that defines a second coil bank, independent of the first coil bank, and wherein a supply of gaseous oxygen is adapted to be releasably connected to the trailing end of the second coil bank, and said lance assembly has second unwinding means that are adapted to draw the tubing off the second reel and forcing it through second straightening means so that the tube is thereby straightened, defining a second lance, so that during operation of the lance assembly, oxygen flows through the second coil bank and second lance, when the second lance is in use, and the second unwinding means are adapted to draw the tubing off the second reel at the same rate that the tube is consumed during the lancing operation.

3. A lance assembly as defined in claim 2 wherein when either the first or second reels support more than one metallic coil simultaneously in its respective coil bank, the trailing end of the preceding coil is connected to the leading end of the trailing coil in the respective coil bank, and wherein the connection between adjacent coils in either coil bank is both gas tight, to prevent the escape of gaseous oxygen flowing through the coil bank, and also adapted to withstand the drawing force of the respective unwinding means without breaking the connection.

4. A lance assembly as defined in claim 3 wherein the first and second unwinding means is a set of first and second pinch rollers respectively, and each set are adapted to grab the metallic tubing that is fed to it from its associated coil bank.

5. A lance assembly as defined in claim 4 wherein the assembly has logic control means that receives signals from a plurality of sensors on the assembly, and command and control signals from an operator, said logic control means are capable of controlling a plurality of servo motors that are used to position the lance assembly in three dimensions, and also control the first and second pinch rollers and activate and deactivate the supply of oxygen to each respective coil bank and associated lance, depending on which lance is in operation at any one time, and the logic control means are capable of retracting the unused lance a sufficient distance, independently of the lance that is in operation, so that the unused lance is kept away from the vicinity of the area being operated upon by the lance that is in operation.

6. A lance assembly as defined in claim 5 wherein the assembly includes a sensor that is capable of determining that the tip of the lance that is in operation is in very close proximity to, or is in fact touching, the plug in the tapping hole being lanced, when the position of the lance tip is advanced towards the plug in the tapping hole being lanced, and when the sensor is tripped, it sends a signal back to the logic control means which then causes the logic control means to rapidly retract the lance a short distance that corresponds to the optimal operational gap between the tip of the lance and the plug in the tapping hole that is being lanced, and this advancement and retraction of the lance is repeated with sufficient frequency so that a mean optimal gap is maintained between the tip of the operating lance and the plug as the lance is consumed, and the face of the plug being lanced melts away, during the lancing operation.

7. A lance assembly as defined in claim 5 wherein the assembly includes a sensor that is able to determine if the joint between adjacent coils in a particular coil bank has failed as the coil is drawn off the reel, and when tripped, the sensor rapidly send a signal to the logic control means that immediately shuts off the supply of oxygen to that coil bank, and rapidly retracts the lance from the tapping hole.

8. A lance assembly as defined in claim 2 wherein the first and second coil banks are comprised of a coil or coils of the same type so that during operation, the operator can operate the lance assembly using one coil bank until it reaches depletion, then rapidly reconfigure the assembly to continue with the lancing operation using the other coil bank, and then once both the first and second coil banks are depleted, the assembly can be taken offline so that the first and second reels on the assembly can be supplied with fresh coils that are then interconnected to therefore replenish the respective coil banks, ready for the next lancing operation.

9. A lance assembly as defined in claim 2 wherein the first and second coil banks are comprised of a coil or coils different types so that one coil bank produces a lance that has different lancing properties to the lance produced by the other coil bank, and the operator can rapidly reconfigure the lance assembly to swap between the two types of lance.

10. A lance assembly as defined in claim 9 wherein the one coil bank is comprised of hollow metal tubing, and the other coil bank is comprised of rod filled tubing, also known as thermic tube.

11. A lance assembly as defined in claim 2 wherein when a plurality of coils are used in a coil bank, the leading end of a particular coil has a region that is narrowed so that narrow region is insertable into the interior diameter of the trailing end of the preceding coil, and the resulting connection has a curved profile that matches the curvature of the coil bank, is gas tight and has sufficient strength that is capable of resisting the tensile force applied to it as it is drawn off its respective reel by its respective pinch roller.

12. A lance assembly as defined in claim 11 wherein a tool is used that is adapted to force the ends together with sufficient force to force the connection.

13. A lance assembly as defined in claim 12 wherein the connection is crimped after the connection has been created to give the connection greater tensile force resistance from the respective coil bank's pinch roller.

14. A lance assembly as defined in claim 2 wherein an insert is used to connect the respective leading and trailing end of adjacent coils in a respective coil bank, and the insert has a similar curved profile to that of the coil bank, and the when each respective end of the adjacent coils are connected to the insert, the resulting join is both gas tight and capable of resisting the tensile force applied to it when it is drawn off its respective reel by the operation of the respective pinch roller.

15. A lance assembly as defined in claim 14 wherein the insert includes at least one O ring for each respective end of the adjacent coils, and the O ring aids in establishing and maintaining a gas tight seal during the unwinding action from its respective coil bank, and subsequent straightening operation.

16. A lance assembly as defined in claim 5 wherein the logic control means are adapted to receive command and control signals remotely from an operator in a separate control room to the furnace, and a combination of sensors and cameras, as well as the preconfigured mapping of the location of each tapping hole in the furnace side wall, combine to enable the lancing assembly to function substantially autonomously.

17. A lance assembly as defined in claim 5 wherein a refractory mud applicator is included in the assembly, and the logic control means is adapted to rapidly reconfigure the assembly so that the mud applicator is used to re-plug the tapping hole when the tapping hole is ready to be re-plugged.

* * * * *